United States Patent [19]

Barto

[11] 4,193,239

[45] Mar. 18, 1980

[54] PREFABRICATED WALL OR CEILING ASSEMBLY

[76] Inventor: LeRoy Barto, Scenic Hills Estates, Harrodsburg, Ky. 40330

[21] Appl. No.: 919,688

[22] Filed: Jun. 27, 1978

[51] Int. Cl.[2] ..... E04B 1/04; E04B 1/74

[52] U.S. Cl. ..... 52/222; 52/404; 52/469; 52/528

[58] Field of Search ..... 52/222, 528, 748, 469, 52/404

[56] References Cited

U.S. PATENT DOCUMENTS

| | | | |
|---|---|---|---|
| 3,254,462 | 6/1966 | Tolek | 52/222 |
| 3,386,220 | 6/1968 | Staats | 52/222 |
| 3,513,608 | 5/1970 | Nagrob | 52/222 |
| 3,641,729 | 2/1972 | Irvin | 52/528 |
| 3,719,013 | 3/1973 | Blick | 52/222 |
| 4,057,941 | 11/1977 | Schwartz | 52/222 |

*Primary Examiner*—William F. Pate, III

[57] ABSTRACT

A wall or ceiling of reusable concrete form assembly which requires no outside support or fasteners and in which interlocking extrusions are adapted to hold panels in tension and where the extrusions have mating portions which can be bent or crimped to join the extrusions and where the tension in the panels is translated back to the extrusions causing them to be more firmly joined.

1 Claim, 5 Drawing Figures

FIG-1
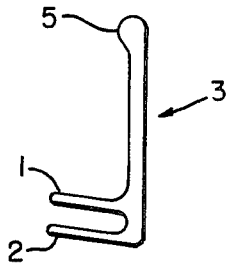
FIG-2
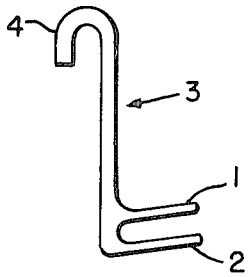
FIG-5
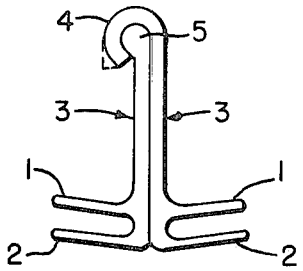
FIG-4
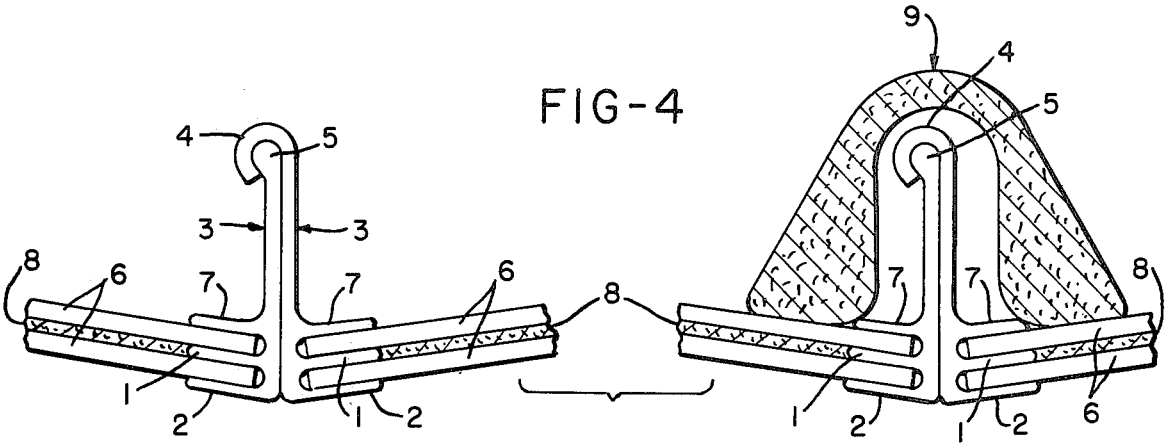
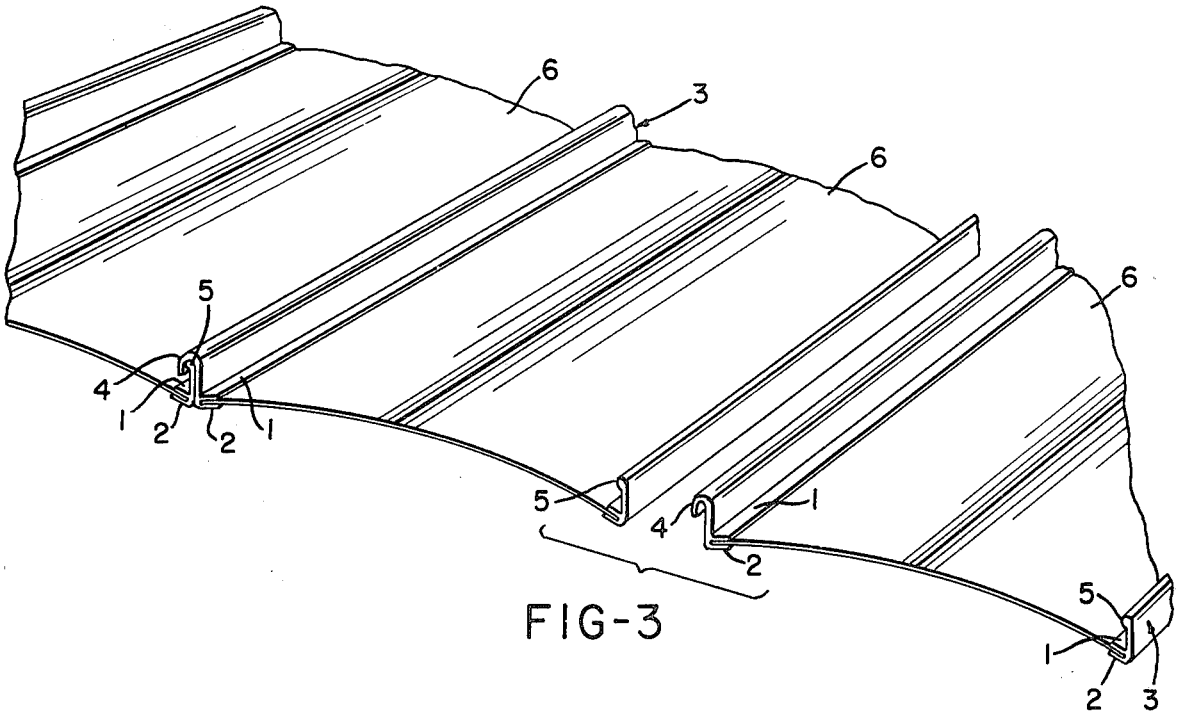
FIG-3

PREFABRICATED WALL OR CEILING ASSEMBLY

BACKGROUND OF THE INVENTION

This invention relates to the assembly of wall or roofing ceiling panels or concrete form assemblies. The high cost of labor in the building trades has placed a premium on the portability prefabrication and ease of assembly of buildings. Preparation of forms in the construction of concrete structures adds significantly to casts. Numerous patents have been issued relating to prefabricated construction units which employ joint structures which receive and hold panels. An example of one such structure is found in the patent to Shimano, No. U.S. Pat. No. 3,738,083. Others employ dovetailing corner assemblies but require separate fasteners to hold the construction together, such as that disclosed in U.S. Pat. No. 3,585,768 issued to Klein. None of prior art show, however, units which require no nails or outside fasteners and which by the method of construction creates tension in the wall panels which is then transmitted back to the joint structure itself causing it to be closed even more effectively.

BRIEF DESCRIPTION OF THE DRAWINGS

FIG. 1 is an end view of an extrusion used in this invention.

FIG. 2 is an end view of the mating extrusion.

FIG. 3 is a perspective view of a typical panel erection.

FIG. 4 is an end view of an extrusion assembly utilizing insulation.

FIG. 5 is an end view of the extrusions mated and crimped into position.

DESCRIPTION OF THE INVENTION

This invention relates to the assembly of roof or wall panels utilizing interlocking extrusions formed either of metal or plastic and forms for concrete construction. FIG. 1 shows an end or top view of one of the two mating extrusions. FIG. 2 discloses the complementing extrusion. Each mating extrusion is equipped with panel holding arms 1 and 2 which together form a slot. Each extrusion has a principal body 3 and one of the coupling units has a lip 4, while its mate is equipped with a bulb 5.

Referring to FIG. 3 the method of assembly and erection is clearly shown. Flat wall or ceil panels 6 are bonded with adhesive or force fit into the slot formed by arms 1 and 2 in each of the two mating extrusions.

The outside faces of the principal body of the extrusions are brought into contact and lip 4 is placed over bulb 5. A crimping tool such as pliers or "Vice-Grip" pliers (the tool would be headed if the extrusions used are plastic) is then used to bend-crimp the edge of lip 4 over bulb 5 to secure it in place. The crimping action is most clearly shown in FIG. 5. The crimping is done at each end and at intermediate intervals throughout the length of the mater extrusions.

Arms 1 and 2, as shown, are formed at an 83 deg. angle from the principal body 3 rather than at right angles. The angle causes the panel to buckle slightly. The resulting tension forces the principal bodies of the mating extrusions together and tightens the joint. The exact angle can be varied depending on the type of material used in the paneling and the degree to which tension is desired in the joint.

One embodiment of the invention is shown at FIG. 4. By forming the mating extrusions with an extra set of penal holding arm 7 the wall can be formed with dual panels in a nearly parallel position. The space between the panels can be filled with insulation 8 to create an all-weather construction. Because the extrusion itself would provide a non-insulated leak point, a cover can be provided for the joint as shown at 9 to provide insulation at the joint. This cover can either be glued in place or can be designed to snap on the principal body of the extrusion.

The foregoing embodiments are illustrative of the invention, but it will be apparent to those skilled in the art that many modification and changes may be made without departing from the essence of the invention. The scope of the invention is defined in the appended claims and all modifications that come within the meaning and range of equivalency of the claims are intended to be included therein.

I claim:

1. A wall or ceiling assembly comprised of two elongated units each having at least three panel engaging arms placed at an angle to the body of the units whereby panels so engaged are placed in tension, the elongated units having integral mating means for mating or crimping one of the mating means to the other, panels engaged by the panel engaging arms of the elongated units whereby tension in the panels caused by the angle of installation is transmitted back to the elongated units causing said elongated units to be pressed together said panels overlying one another with a space therebetween and insulating material contained in said space between the panels.

* * * * *